United States Patent [19]

Doring

[11] 4,142,821

[45] Mar. 6, 1979

[54] GROUND STABILIZATION ARRANGEMENT FOR DAM EMBANKMENTS AND OTHER TERRAIN SLOPES AND THE LIKE

[76] Inventor: Erich Döring, Langer Weg 3, 8052 Moosburg, Germany

[21] Appl. No.: 733,024

[22] Filed: Oct. 15, 1976

[30] Foreign Application Priority Data

Oct. 16, 1975 [DE] Fed. Rep. of Germany ..... 2546430

[51] Int. Cl.[2] ..... E02D 3/08

[52] U.S. Cl. ..... 405/258; 405/16

[58] Field of Search ..... 61/37, 38, 35, 3, 4; 152/323, 185, 208

[56] References Cited

U.S. PATENT DOCUMENTS

| | | | |
|---|---|---|---|
| 969,717 | 9/1910 | Nelson | 152/323 |
| 1,905,176 | 4/1933 | Kieckhefer | 61/35 |
| 2,525,196 | 10/1950 | Bacon | 152/323 |
| 3,276,210 | 10/1966 | Stitt | 61/5 |
| 3,970,131 | 7/1976 | Schelkmann | 152/185 |
| 3,990,247 | 11/1976 | Palmer | 61/37 |

FOREIGN PATENT DOCUMENTS

| | | | |
|---|---|---|---|
| 2156277 | 5/1973 | Fed. Rep. of Germany | 61/37 |

*Primary Examiner*—Jacob Shapiro
*Attorney, Agent, or Firm*—Dressler, Goldsmith, Clement, Gordon & Shore, Ltd.

[57] ABSTRACT

The present invention relates to a ground stabilization arrangement a structure for dam embankments and other terrain slopes and the like, consisting of interconnected elements of old automobile tires.

9 Claims, 4 Drawing Figures

Figure 1:
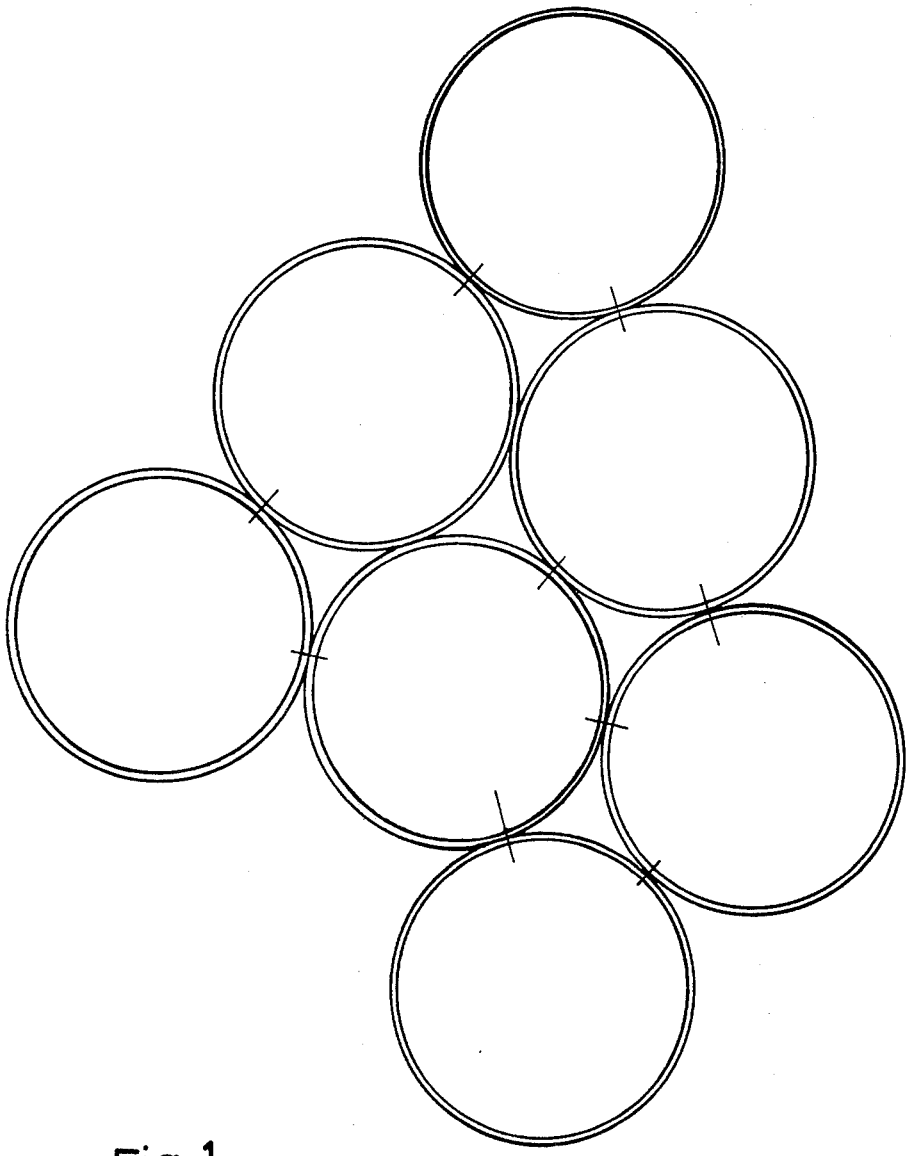

GROUND STABILIZATION ARRANGEMENT FOR DAM EMBANKMENTS AND OTHER TERRAIN SLOPES AND THE LIKE

The embankments of dams and rivers and earth or stone fills of slopes or cuts in terrain often are protected against landslides by planting and/or other means of stabilization. If the slopes are not too steep but rather flat, stabilizations are provided in the form of pavements of natural or concrete sectional brick with openings in which plants are put. In the simplest case grass may be used. The plants in between pavements frequently require some care, such as gardening because a goodlooking slope is desired. The care of this kind of stabilization arrangement, for example mowing the grass often is interfered with because some of the concrete bricks which have adopted an inclined position in the meantime and stick out of the ground impede the mowing or cannot be run over by maintenance vehicles because the projecting parts do not yield. Thus damages to lawn mowers can hardly be prevented. The use of rubber-elastic pavements is not feasible for reasons of expense; any kind of concrete paving material is relatively inexpensive. On the other hand, metal stabilizations are avoided whenever possible because of the risk of corrosion. According to another known proposal the ground stabilization arrangement is made from a prefabricated network of old tires which are interconnected by wire, steel band, clips, hooks or the like. However, when laid in the ground such a network of complete old tires can never be filled so reliably that cavities are avoided which will then become breeding places for vermin. Moreover, the interior of the tire cannot be filled sufficiently with earth. The sidewalls of the tire prevent the roots from growing properly in the ground of the slope. The slopes remain soft shoulders because the cavities in the old tires provide too much resiliency.

It is the object of the present invention to provide an arrangement of ground stabilization elements for flat slopes of dams and the like which can be made from resilient and cheap elements which, in spite of their nature, do not afford a flexible resilient slope. It is another object of the invention to provide ground stabilization arrangements of the kind mentioned which are insensitive to ambient temperature changes. It is yet another object of the invention to provide a ground stabilization arrangement which can be grown over completely. A still further object of the invention is the provision of a ground stabilization arrangement which can be run over by vehicles.

These and other objects of the invention as will become apparent as the description proceeds, are met in accordance with the invention in that the body elements of the ground stabilization arrangement are formed exclusively by the annular tread strips of the old pneumatic automobile tires from which the sidewalls were separated and which are placed against one another with their peripheral surfaces in contact with each other and interconnected by rivets, screws, clamps, wire, and the like to form a mat-like structure.

When the mat-like structure is installed upon the terrain slope for which it is to provide ground stabilization, the peripheral surfaces of the annular tread strips are oriented generally perpendicular to the terrain slope.

The structure thus installed is substantially free of any body elements oriented parallel to the terrain slope, and the spaces occupied by the various body elements are quite narrow in their horizontal dimensions. As a result, the spaces defined by the body elements within the vertical walls of a given annular tread strip and between adjacent annular strips may be quickly, fully, and firmly filled with earth or other suitable fill material. Furthermore, the space occupied by each individual pneumatic tire annular tread strip is so narrow that, whether or not some additional fill material is deposited over the top thereof, the tread strip can be obscured from view, if desired, by causing grass or other suitable ground covering to grow over the tread strip. All the disadvantages of the prior art ground stabilization arrangements referred to above are thereby avoided.

Old tires of cars and trucks are available in great numbers and any desired size. The material practically does not corrode. Old tires can be processed readily without requiring any expensive special machinery or other special equipment. The sidewalls can be cut off from the remainder of the tire by any conventional mechanical cutting tool or scissors. Also an adaptation of the body elements with regard to size (diameter and height) is obtained without any problem by proper selection of old tires even if the body elements are made in series production since there is such a great amount of old tires of any size. This useful application of old tires for the above mentioned purposes also helps resolve the urgent problem of waste removal or recycling in an extremely practical way.

In accordance with the invention the sidewalls must be removed from the old tires because otherwise it is not possible to obtain a firm and generally unyielding slope stabilization arrangement. Moreover, this will permit the roots to grow properly in the ground. Transportation of interconnected or hooked body elements of the annular tread strips is no problem since the body elements have little weight. If the slopes are rather steep it will be attempted to select quite small segments to make up the tread strip structure. When the gradient is less steep the annular shape of the body elements will be retained and they will be connected to other similar elements. It is easy to fill the body elements with earth without creating any cavities. Only the narrow edges of the tread strips will extend parallel to the ground surface. The earth in the tread strip elements can be compacted by any conventional method. The roots can grow freely in any direction and become entangled with the underground. Meadows or the like may completely overgrow the stabilization structure in a dam or slope.

Adjacent or neighboring tread strips are interconnected by rivets. Suitable rivets are blanks of a kind not requiring any pre-punching. Thus larger assemblies can be produced in factories and yet be capable of being handled and transported. Upon laying on the slope such mat-like arrangements are connected to one another in the same manner. However, for this purpose normally galvanized screws will be used because in that manner it is easier to interconnect the mats than by rivets and no special tools are needed. Of course, it is also possible to screw together the individual body elements at the factory site. In that case they may be separated readily at any location of the arrangement at a later time.

The annular tread strips need not be inserted in their original ring shape. The ring shape is especially applicable with smaller tires.

Especially if greater tires are used, it is the aim of the invention to achieve smaller openings in which to set plants. For this reason two opposed, especially diametrically opposed portions of each tread strip ring of each body element are interconnected by rivets, screws, or the like. With the drop-shaped loops thus formed the body elements are connected to one another either at adjacent loops alone or in addition also at each such joint and the drop-shaped loop of the neighboring body element. Each drop-shaped loop of a body element is connected to two, three, or four other loops depending on the desired closeness and tightness of the ground stabilization arrangement. These connections may be made at the central zone where two opposed portions of a single body element are connected to each other.

Of course it is also possible, especially when very great tires are used, to connect more than two opposed portions of the annular tread strip to each other. The same kind of connection can be established at other portions as well so that the original annular ring-shaped tread strip will be remodeled to have two, three, or more loops.

Figure 2:
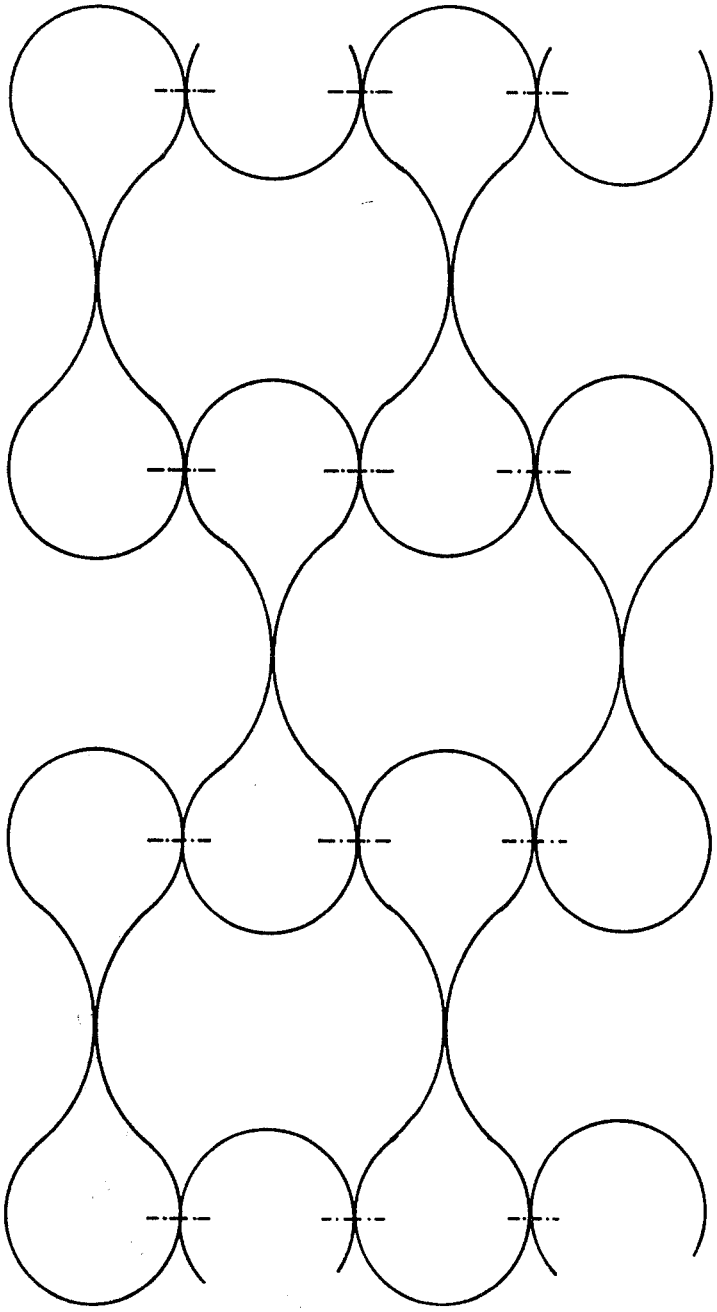
Figure 3:
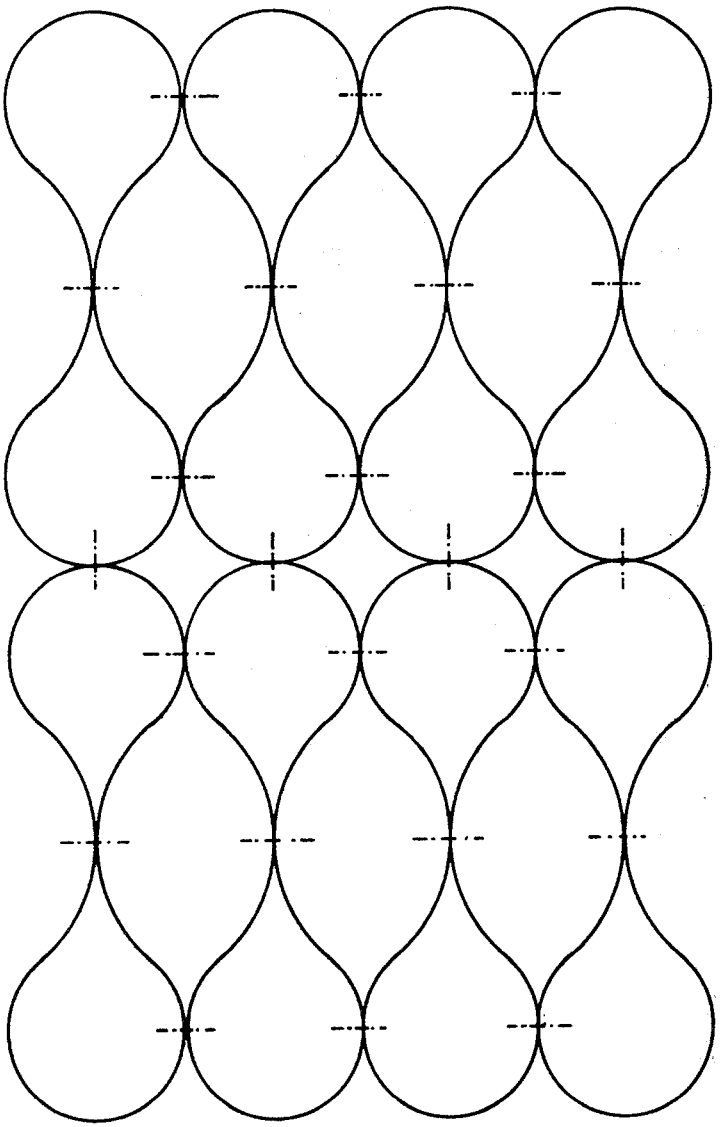
Figure 4:
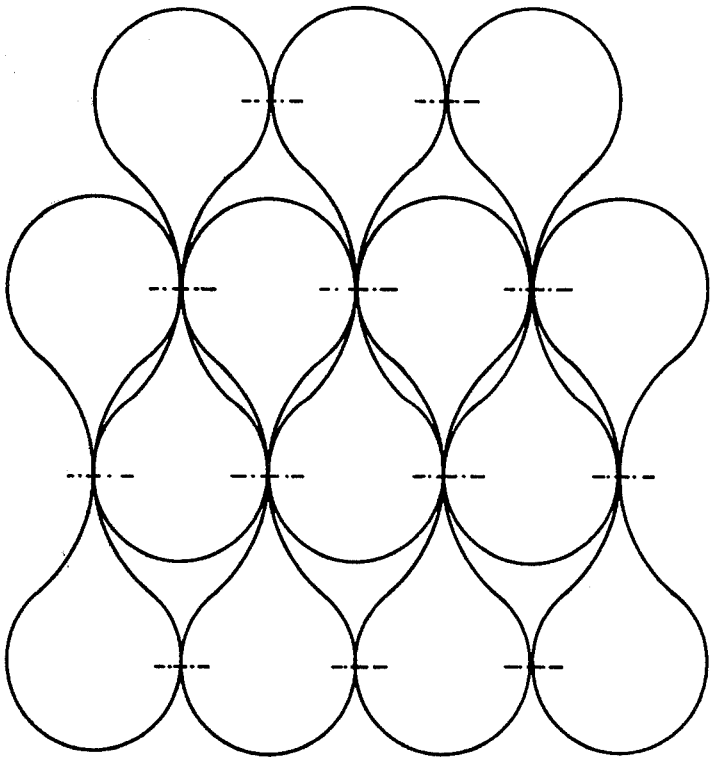

The invention will be described further, by way of example, with reference to the accompanying drawings, in which:

FIG. 1 is a ground stabilization arrangement of ring-shaped body elements,

FIG. 2 is a ground stabilization arrangement of automobile tire tread strip rings connected within themselves and to one another at opposed locations, the individual body elements being offset relative to one another, FIG. 3 is a ground stabilization arrangement composed of individual body elements according to FIG. 2, all the body elements being connected beside and behind one another, FIG. 4 is a ground stabilization arrangement composed of individual body elements according to FIGS. 2 and 3, some of the loops formed being connected to the central portions of other body elements and others being connected to corresponding loops.

The ground stabilization arrangement shown in FIG. 1 uses ring-shaped tread strips recovered from old conventional passenger car tires by separating the sidewalls from them in the area of the shoulders, retaining the tread strips in their original circular shape. The arrangement is hexagonal so that each ring-shaped tread strip is connected to a total of six adjacent tread strips abutting one another by their peripheral surfaces. The connections are made by rivets. With a diameter of the ring-shaped body elements of 50 to 60 cm. the height may be from 14 to 18 cm. Although the tire carcass is cut, corrosion need not be feared. However, when using steel belt tires, attempts should be made not to cut into the steel belt. This not only prevents corrosion of the steel but also wear of the scissors used to cut off the sidewalls.

With the ground stabilization arrangements shown in FIGS. 2 to 4 the body elements of the tread strips of old car tires were obtained by grasping the ring-shaped tread strip at two diametrically opposed locations, pressing these together, and connecting them at the place of contact by a rivet, thus forming two opposed drop-shaped loops. The individual body elements abut one another only at the loops. According to FIG. 2 adjacent body elements are displaced upwardly so that the upper loops of a row of body elements are connected with the lower loops of another row of body elements disposed above the same. In other words, each loop is connected to two other ones, one at either side. In the arrangement shown in FIG. 3 all body elements are connected side by side, at the upper and lower loops. The adjacent row of similar structure is placed exactly above said first mentioned row so that the longitudinal axes of the individual body elements coincide on a common line. In another arrangement, not shown, the rows are offset by half the dimension of division of the body elements in a row so that the loops of an upper row will come to lie between the two loops of a lower row, i.e. staggered so as to fill the gaps.

A particularly tight and firm composite structure is obtained with an arrangement according to FIG. 4. Again individual body elements as before are used. However, at the place at which two diametrically opposed portions of a tread strip are interconnected, at the same time, another loop of another body element is connected so that in general a very close structure is achieved. This kind of connection cannot be obtained between every two adjacent rows but instead in a definite pattern alternatingly, for instance, with connections to adjacent upper and lower rows (not shown in FIG. 4) of the kind illustrated in FIG. 3.

Ground stabilization arrangements can be made which cover great areas and are locally yielding to accomodate limited local ground changes without rupture.

What is claimed is:

1. A ground stabilization arrangement for a dam embankment, other terrain slope, and the like, comprising a plurality of flexible, continuous rings, each said ring having a generally flat, rectilinear cross section and a width no greater than one-twelfth of the perimeter of the peripheral surface of the ring, said rings being interconnected with their peripheral surfaces in contact and interconnected by rivets, screws, clamps or wire to form a mat-like structure which, when installed upon said terrain slope, has its said peripheral surfaces oriented generally perpendicular to said terrain slope, said mat-like structure thus installed being substantially open and said rings being free of any flange portions oriented parallel to said terrain slope.

2. A ground stabilization arrangement for a dam embankment, other terrain slope, and the like, consisting of interconnected elements of old pneumatic automobile tires, characterized in that the body elements are formed exclusively by the annular tread strips of said old automobile tires without the sidewalls thereof, said annular tread strips being placed against one another with two directly opposed inner portions of each of said annular tread strips of each of said body elements being in contact with each other to form a pinched region and being interconnected by first rivets, screws, or the like at the pinched region to form two drop-shaped loops, one on each side of said pinched region, and in that the drop-shaped loops thus formed from each tread strip are placed adjacent the drop-shaped loops of adjacent tread strips and interconnected by additional rivets, screws or the like at locations spaced from the pinched regions.

3. A ground stabilization arrangement for a dam embankment, other terrain slope, and the like, consisting of interconnected elements of old pneumatic automobile tires, characterized in that the body elements are formed exclusively by the annular tread strips of said old automobile tires without the sidewalls thereof, said annular tread strips being placed against one another with two directly opposed inner portions of each of said annular tread strips of each of said body elements being in contact with each other to form a pinched region and interconnected by rivets, screws, or the like at the pinched region to form two drop-shaped loops, one on each side of said pinched region, and in that the drop-shaped loops thus formed are interconnected at a location on their perimeters spaced from their pinched region to said interconnecting rivets, screws or the like at said pinched region of an adjacent tread strip.

4. A ground stabilization arrangement according to claim 2, characterized in that each drop-shaped loop of a body element is connected to two further loops.

5. A ground stabilization arrangement according to claim 2, characterized in that each drop-shaped loop of a body element is connected to three further loops.

6. A ground stabilization arrangement according to claim 2, characterized in that each drop-shaped loop of a body element is connected to four further loops.

7. A ground stabilization arrangement according to claim 3, characterized in that each drop-shaped loop of a body element is connected to two further loops.

8. A ground stabilization arrangement according to claim 1 in which each said ring has a thickness less than one-hundredth of the perimeter of the peripheral surface of the rings.

9. A ground stabilization arrangement according to claim 1 in which at least one of said rings is substantially circular.

* * * * *